United States Patent [19]

Lord et al.

[11] Patent Number: 4,549,403

[45] Date of Patent: Oct. 29, 1985

[54] METHOD AND CONTROL SYSTEM FOR PROTECTING AN EVAPORATOR IN A REFRIGERATION SYSTEM AGAINST FREEZEUPS

[75] Inventors: Richard G. Lord, Liverpool; Kenneth J. Nieva, Mattydale, both of N.Y.

[73] Assignee: Carrier Corporation, Syracuse, N.Y.

[21] Appl. No.: 597,332

[22] Filed: Apr. 6, 1984

[51] Int. Cl.[4] ..... F25D 17/02

[52] U.S. Cl. ..... 62/201; 62/209

[58] Field of Search ..... 62/139, 140, 150, 151, 62/156, 185, 201, 209, 227

[56] References Cited

U.S. PATENT DOCUMENTS

| | | | |
|---|---|---|---|
| 1,954,455 | 4/1934 | Morse et al. | 62/185 X |
| 2,224,629 | 12/1940 | Borse et al. | 62/201 X |
| 2,666,298 | 1/1954 | Jones | 62/209 X |
| 2,968,167 | 1/1961 | Raney | 62/209 X |

*Primary Examiner*—Harry Tanner

*Attorney, Agent, or Firm*—Robert H. Kelly

[57] ABSTRACT

A method and control system are disclosed for operating a refrigeration system to protect an evaporator in a refrigeration system against freezeups of a heat transfer fluid cooled in the evaporator by operation of the refrigeration system. A first signal indicative of the temperature of the heat transfer fluid in the evaporator and a second signal indicative of the temperature of the heat transfer fluid leaving the evaporator are provided to a microcomputer system which processes the first and second signals to determine when the temperature of the heat transfer fluid in the evaporator falls below the temperature of the heat transfer fluid leaving the evaporator by a selected amount. The microcomputer system generates an alarm signal to shut down operation of the refrigeration system if the microcomputer system determines that the temperature of the heat transfer fluid in the evaporator is less than the temperature of the heat transfer fluid leaving the evaporator by the selected amount.

4 Claims, 1 Drawing Figure

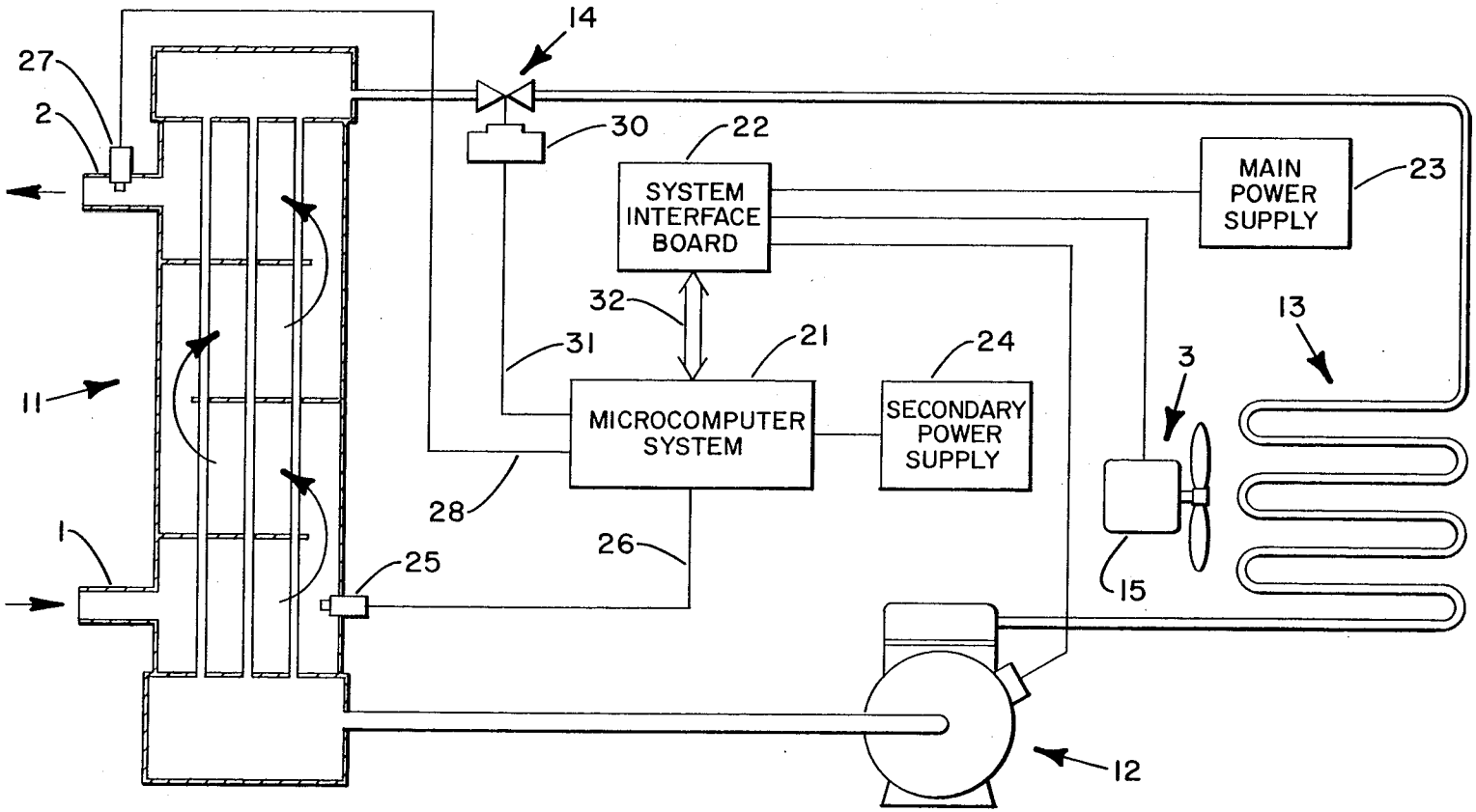
MAIN POWER SUPPLY
SECONDARY POWER SUPPLY
SYSTEM INTERFACE BOARD
MICROCOMPUTER SYSTEM
23
13
3
15
12
24
21
22
32
31
30
14
26
28
25
27
2
11
1

METHOD AND CONTROL SYSTEM FOR PROTECTING AN EVAPORATOR IN A REFRIGERATION SYSTEM AGAINST FREEZEUPS

BACKGROUND OF THE INVENTION

The present invention relates to refrigeration systems and, more particularly, relates to methods and control systems for protecting evaporators in refrigeration systems against freezeups.

Conventional refrigeration systems utilize a recirculating refrigerant for removing heat from the low temperature side of the refrigeration system and for discharging heat at the high temperature side of the refrigeration system. The work input necessary to operate the refrigeration system is provided by a motor driven compressor which receives low pressure gaseous refrigerant and compresses it to a high pressure. This high pressure gaseous refrigerant is supplied to a condenser where heat is removed from the gaseous refrigerant to condense it to a liquid. This liquid refrigerant is then supplied through an expansion valve to an evaporator wherein heat is transferred from a heat transfer fluid to the liquid refrigerant to evaporate the liquid refrigerant. The heat transfer fluid is thereby cooled and then used to cool a load, such as to cool a building. This evaporated refrigerant from the evaporator is returned to the compressor for recirculation through the refrigeration system.

Normally, the heat transfer fluid used in an evaporator of a conventional refrigeration system of the type described above is a liquid such as water. Usually, the liquid enters one end of the evaporator, is cooled as it flows through the evaporator, and then exits at another opposite end of the evaporator. It is highly desirable to maintain the heat transfer liquid flowing through the evaporator at a temperature above the freezing temperature of the heat transfer liquid. If the liquid is not maintained above its freezing temperature then the liquid may freeze in the evaporator thereby preventing proper operation of the refrigeration system and possibly damaging the evaporator. This is especially true if the heat transfer fluid is water because water increases in volume when changing state from a liquid to a solid.

The danger of the heat transfer fluid freezing in the evaporator is increased if due to some malfunction there is no flow or abnormally low flow of the heat transfer fluid through the evaporator. Therefore, flow sensors have been used to detect whether there is normal flow of heat transfer fluid through an evaporator when a refrigeration system is operating. If no flow or an abnormally low flow is detected the refrigeration system is shut down. However, these flow sensors are mechanical devices inherently subject to mechanical failure or difficulties which may provide a faulty indication of the flow through the evaporator thereby needlessly shutting down operation of the refrigeration system or possibly allowing a freezeup to occur in the evaporator. Also, these flow sensors provide no direct indication of the actual temperature of the heat transfer fluid flowing through the evaporator relative to the freezing temperature of the heat transfer fluid. Therefore, another protection device for sensing the actual temperature of the heat transfer fluid must be provided in addition to the flow sensor.

SUMMARY OF THE INVENTION

Therefore, it is an object of the present invention to efficiently and reliably protect an evaporator in a refrigeration system against freezeups of a heat transfer fluid in the evaporator due to no flow or abnormally low flow of the fluid through the evaporator.

This and other objects of the present invention are attained by a method and control system for operating a refrigeration system to determine when the temperature of a heat transfer fluid cooled in an evaporator of the refrigeration system is less than the temperature of the heat transfer fluid leaving the evaporator by a preselected amount and to shut down operation of the refrigeration system when this condition occurs. According to the present invention, the temperature of the heat transfer fluid in the evaporator is sensed and a first signal indicative of this sensed temperature is provided to a processor means, such as a microcomputer. Also, the temperature of the heat transfer fluid leaving the evaporator is sensed and a second signal indicative of this sensed temperature is also supplied to the processor means. The processor means compares the first and second signals to determine when the temperature of the heat transfer fluid in the evaporator is less than the temperature of the heat transfer fluid leaving the evaporator by a selected amount. If this condition is detected then the processor means generates an alarm signal and operation of the refrigeration system is shut down in response to this alarm signal.

BRIEF DESCRIPTION OF THE DRAWINGS

Other objects and advantages of the present invention will be apparent from the following detailed description in conjunction with the accompanying drawing in which:

The FIGURE is a schematic illustration of a refrigeration system with a control system for operating the refrigeration system according to the principles of the present invention.

DESCRIPTION OF THE PREFERRED EMBODIMENT

The FIGURE is a schematic illustration of a refrigeration system having a control system for operating the refrigeration system according to the principles of the present invention. As shown in the FIGURE, the refrigeration system comprises an evaporator 11, a compressor 12, an air-cooled condenser 13, and an expansion valve 14, connected in the usual manner. Also, as shown in the FIGURE, the control system comprises a microcomputer system 21, a system interface board 22, a main power supply 23, and a secondary power supply 24. Further, as shown in the FIGURE, a first temperature sensor 25 is provided near an inlet line 1 into the evaporator 11 for sensing the temperature of a heat transfer fluid in the evaporator 11 and for providing a signal indicative of this sensed temperature via electrical lines 26 to the microcomputer system 21. Still further, as shown in the FIGURE, a second temperature sensor 27 is provided for sensing the temperature of the heat transfer fluid leaving the evaporator 11 through an outlet line 2 and for providing a signal indicative of this sensed temperature via electrical lines 28 to the microcomputer system 21.

Preferably, the temperature sensors 25, 27 are temperature responsive resistance devices such as thermistors. However, as will be readily apparent to one of ordinary skill in the art to which the present invention pertains, many types of sensors may be employed as temperature sensors 25 and 27. Generally, any type of temperature sensor may be used which is capable of providing a signal indicative of the sensed temperature to the microcomputer system 21.

The microcomputer system 21 may be any device, or combination of devices, suitable for receiving input signals, for processing the received input signals according to preprogrammed procedures, and for generating control signals in response to the processed input signals. The control signals generated by the microcomputer system 21 are supplied to control devices which control the operation of the refrigeration system in response to the control signals provided to the control devices from the microcomputer system 21. For example, the microcomputer system 21 may be a model 8031 microprocessor with a model 2764 memory device which are available from Intel Corporation which has a place of business at 3065 Bowers Avenue, Santa Clara, Calif. 95051.

As shown in the FIGURE, the secondary power supply 24 is connected to the microcomputer system 21 so that the microcomputer system 21 controls electrical power flow from the secondary power supply 24 via electrical lines 31 to a motor 30 which opens and closes the expansion valve 14. Preferably, the expansion valve 14 is an incrementally adjustable electronic expansion valve such as described in U.S. patent application Ser. No. 564,543 entitled "Incrementally Adjustable Electronic Expansion Valve" which was filed in the United States Patent and Trademark Office on Dec. 22, 1983 and which is assigned to the same assignee as the present patent application. Also, preferably, the expansion valve 14 is controlled in the manner disclosed in U.S. patent application Ser. No. 564,542 entitled "Control System For An Electronic Expansion Valve In A Refrigeration System" which was also filed in the United States Patent and Trademark Office on Dec. 22, 1983 and which is also assigned to the same assignee as the present patent application. The entire disclosures of the foregoing United States patent applications are incorporated herein by reference.

Further, as shown in the FIGURE, the system interface board 22 is connected to the microcomputer system 21 by a ribbon cable 32. The system interface board 22 includes switching devices for controlling electrical power flow from the main power supply 23 to a compressor motor for driving the compressor 12 and to a motor 15 for driving a condenser fan unit 3 for circulating cooling air over the condenser 13. Preferably, the switching devices are electronic components, such as relays, which are controlled in response to control signals from the microcomputer system 21 which are supplied through the ribbon cable 32 to the electronic components on the system interface board 22.

According to the present invention, when the refrigeration system is operating, the temperature sensor 25 provides an electrical signal via the electrical lines 26 to the microcomputer system 21 which is indicative of the temperature of the heat transfer fluid in the evaporator 11 as sensed by the temperature sensor 25. Also, the temperature sensor 27 provides an electrical signal via electrical lines 28 to the microcomputer system 21 which is indicative of the sensed temperature of the heat transfer fluid leaving the evaporator 11 through the outlet line 2. The microcomputer system 21 processes the received electrical signals provided by the temperature sensors 25, 27 according to preprogrammed procedures to determine the absolute temperature difference between the heat transfer fluid in the evaporator 11 and the temperature of the heat transfer fluid leaving the evaporator 11. Under normal operating conditions, the temperature of the heat transfer fluid leaving the evaporator 11 is less than the temperature of the heat transfer fluid in the evaporator 11 by a significant amount. However, if due to some malfunction, there is no flow or abnormally low flow of heat transfer fluid through the evaporator 11 the temperature of the heat transfer fluid in the evaporator 11 as sensed by the temperature sensor 25 may eventually fall below the temperature of the heat transfer fluid leaving the evaporator 11 as sensed by the temperature sensor 27. This is true because the refrigeration system will continue to operate at normal capacity to cool the heat transfer fluid in the evaporator 11 even though a normal amount of heat transfer fluid is not flowing through the evaporator 11.

When the temperature of the heat transfer fluid in the evaporator as sensed by the temperature sensor 25 falls below the temperature of the heat transfer fluid in the outlet line 2 from the evaporator 11 by an amount which clearly indicates an abnormal situation, the microcomputer system 21 generates an alarm signal. For example, the microcomputer system 21 may be programmed to generate an alarm signal when the temperature of the heat transfer fluid in the evaporator 11 as sensed by the temperature sensor 25 is 5° F. (−15° C.) less than the temperature of the heat transfer fluid leaving the evaporator 11 as sensed by the temperature sensor 27, thereby clearly indicating that there is no flow of the heat transfer fluid through the evaporator 11.

When the microcomputer system 21 generates an alarm signal, appropriate switching devices on the system interface board 22 are opened to prevent the flow of electrical power from the main power supply 23 through the system interface board 22 to the condenser fan motor 15 and to the motor for driving the compressor 12. Also, in response to an alarm signal, the microcomputer system 21 operates to provide electrical power from the secondary power supply 24 via the electrical lines 31 to the motor 30 to drive the expansion valve 14 to its fully closed position. Thus, the refrigeration system is effectively shut down in response to the microcomputer system 21 generating an alarm signal in response to abnormal sensed temperature conditions of the heat transfer fluid flowing through the evaporator 11. This effectively, efficiently, and reliably protects the refrigeration system evaporator 11 from freezeups of the heat transfer fluid in the evaporator 11 due to no flow or abnormally low flow of the heat transfer fluid through the evaporator 11.

It should also be noted that the foregoing method of operation also protects against undesirable reverse flow of heat transfer fluid through the evaporator 11 from the outlet line 2 to the inlet line 1. In such a reverse flow situation, the temperature sensor 25 will sense a temperature less than the temperature sensed by the temperature sensor 27 sometime soon after startup of the refrigeration system. This will cause the alarm signal to be generated by the microcomputer system 21 thereby shutting down operation of the refrigeration system.

Of course, the foregoing description is directed to a preferred embodiment of the present invention and various modifications and other embodiments of the present invention will be readily apparent to one of ordinary skill in the art to which the present invention pertains. Therefore, while the present invention has been described in conjunction with a particular embodiment it is to be understood that various modifications and other embodiments of the present invention may be made without departing from the scope of the invention as described herein and as claimed in the appended claims.

What is claimed is:

1. A method of operating a refrigeration system having an evaporator for cooling a heat transfer fluid passed through the evaporator, comprising:

determining the temperature of the heat transfer fluid in the evaporator and the temperature of the heat transfer fluid leaving the evaporator; and shutting down operation of the refrigeration system when the temperature of the heat transfer fluid in the evaporator is less than the temperature of the heat transfer fluid leaving the evaporator by a preselected amount.

2. A method of operating a refrigeration system having an evaporator for cooling a heat transfer fluid passed through the evaporator, comprising:

sensing the temperature of the heat transfer fluid in the evaporator;

sensing the temperature of the heat transfer fluid leaving the evaporator;

comparing the sensed temperatures to determine when the temperature of the heat transfer fluid in the evaporator is less than the temperature of the heat transfer fluid leaving the evaporator by a selected amount; and shutting down operation of the refrigeration system when the temperature of the heat transfer fluid in the evaporator is less than the temperature of the heat transfer fluid leaving the evaporator by the selected amount as determined by the step of comparing.

3. A control system for a refrigeration system having an evaporator for cooling a heat transfer fluid passed through the evaporator, comprising:

means for determining the temperature of the heat transfer fluid in the evaporator and the temperature of the heat transfer fluid leaving the evaporator; and means for shutting down operation of the refrigeration system when the temperature of the heat transfer fluid in the evaporator is less than the temperature of the heat transfer fluid leaving the evaporator by a preselected amount.

4. A control system for a refrigeration system having an evaporator for cooling a heat transfer fluid passed through the evaporator, comprising:

first sensor means for sensing the temperature of the heat transfer fluid in the evaporator and for generating a first signal indicative of this sensed temperature;

second sensor means for sensing the temperature of the heat transfer fluid leaving the evaporator and for providing a second signal indicative of this sensed temperature;

processor means for receiving the first and second signals from the first sensor means and second sensor means, respectively, for processing the first and second signals and for generating an alarm signal when the temperature of the first signal is less than the second signal by a preselected amount; and means for shutting down operation of the refrigeration system in response to generation of an alarm signal by the processor means.

* * * * *